United States Patent [19]

Tamura et al.

[11] 4,355,616

[45] Oct. 26, 1982

[54] FUEL SUPPLY CONTROL SYSTEM FOR AN INTERNAL COMBUSTION ENGINE OF AN AUTOMOTIVE VEHICLE

[75] Inventors: Hideyuki Tamura, Yokohama; Kenji Ikeura, Yokosuka, both of Japan

[73] Assignee: Nissan Motor Company, Limited, Yokohama, Japan

[21] Appl. No.: 149,144

[22] Filed: May 14, 1980

[30] Foreign Application Priority Data

May 15, 1979 [JP] Japan ..... 54-58681

[51] Int. Cl.[3] ..... F02B 3/00

[52] U.S. Cl. ..... 123/440; 123/489

[58] Field of Search ..... 123/440, 489

[56] References Cited

U.S. PATENT DOCUMENTS 4,165,719 8/1979 Asano ..... 123/440

4,170,040 10/1977 De Blanc ..... 123/440

*Primary Examiner*—Ronald B. Cox

*Attorney, Agent, or Firm*—Schwartz, Jeffery, Schwaab, Mack, Blumenthal & Koch

[57] ABSTRACT

A fuel supply system for an internal combustion engine of an automobile is disclosed which comprises a sensor for detecting an air flow rate in an intake passage, a detector for detecting rotation frequency of an engine, a sensor for detecting an oxygen concentration in an exhaust gas, a detector such as a throttle valve switch for detecting an acceleration or deceleration of the engine and a table of correction coefficients with the rotation frequency of the engine and the air flow rate in the intake passage as parameters. A feedback control of a fuel feed quantity is effected to achieve a theoretical valve of air-fuel ratio by an output of the oxygen concentration sensor if the correction coefficient is within a certain range but said feedback control is halted and the fuel feed quantity is corrected based on the correction coefficient if the correction coefficient is beyond said certain range. Said correction of the fuel feed quantity based on the correction coefficient is not effected at the accelerating or decelerating time when the air flow rate in the intake passage abruptly varies even if the correction coefficient is beyond said certain range.

18 Claims, 10 Drawing Figures

| | | | | | | | | |
|---|---|---|---|---|---|---|---|---|
| 6.5 | 1.31 | 1.18 | 1.21 | 1.26 | 1.28 | 1.28 | 1.28 | 1.28 |
| 6.0 | 1.28 | 1.17 | 1.18 | 1.23 | 1.28 | 1.28 | 1.24 | 1.28 |
| 5.5 | 1.27 | 1.00 | 1.10 | 1.10 | 1.24 | 1.20 | 1.25 | 1.31 |
| 4.5 | 1.05 | 1.00 | 1.00 | 1.00 | 1.16 | 1.18 | 1.25 | 1.20 |
| 4.0 | 1.04 | 1.00 | 1.00 | 1.00 | 1.00 | 1.00 | 1.23 | 1.20 |
| 3.0 | 1.06 | 1.00 | 1.00 | 1.00 | 1.00 | 1.05 | 1.23 | 1.21 |
| 2.0 | 1.07 | 1.00 | 1.00 | 1.00 | 1.00 | 1.06 | 1.23 | 1.23 |
| 1.0 | 1.06 | 1.00 | 1.00 | 1.00 | 1.15 | 1.18 | 1.19 | 1.23 |
| Tp / N | 400 | 800 | 2000 | 2800 | 3600 | 4200 | 5200 | 6000 |

FUEL SUPPLY CONTROL SYSTEM FOR AN INTERNAL COMBUSTION ENGINE OF AN AUTOMOTIVE VEHICLE

BACKGROUND OF THE INVENTION

1. Field of the Invention

The present invention relates generally to a fuel supply control system for an internal combustion engine of an automotive vehicle for controlling the air/fuel ratio of an air-fuel mixture. More particularly, the present invention relates to a fuel supply control system for controlling the fuel amount to be supplied to an internal combustion engine, in which the fuel injection amount is determined by either feedback control or open loop control.

2. Description of the Prior Art

Generally a fuel supply control system for an internal combustion engine comprises an air flow sensor, such as an air flow meter provided adjacent to an air intake for determining an air flow rate in an air intake passage, a detector, such as a crank angle sensor, for detecting engine speed, an exhaust gas sensor such as an oxygen sensor for detecting oxygen consentration in the exhaust gas, a detector such as throttle valve angle sensor for detecting opening and closing of the throttle valve and thereby detecting acceleration and deceleration of the vehicle and a two-dimentional table for determining correction coefficient of fuel injection amount. The table is defined by the engine speed and air flow rate as control parameters for controlling the air/fuel ratio of the air-fuel mixture. The fuel injection amount is controlled by calculating a correction coefficient based on the inputted parameters and inputting a control output as the result of calculation to a fuel supply control means such as a fuel injector, carburetor and so on.

In such a fuel supply control system, the fundamental or basic fuel injection amount is determined corresponding to the engine speed and air flow rate. The correction coefficient for correcting the determined basic fuel injection rate is also determined corresponding to the engine speed and air flow rate by way of looking up the table. On the other hand, for selectively carrying out feedback control and open loop control, the determined correction coefficient is compared with 1. If the correction coefficient is 1, feedback control for determining fuel injection amount based on the exhaust gas sensor signal is carried out. Such feedback control controlling the fuel injection amount to approach the required air/fuel ratio based on the exhaust gas sensor signal is called λ-control (hereinafter the word "λ-control" will be used as the above-mentioned meaning). When the correction coefficient exceeds 1, λ-control is clamped and open loop control is carried out. In open loop control, the fuel injection amount is determined by calculating the basic fuel injection amount and correction coefficient.

In the conventional fuel supply control system, since the air flow sensor signal lags in responding to a varying of the air flow rate and sometimes causes overshoot, calculations for obtaining the basic fuel injection amount and correction coefficient sometimes are in error. Particularly, immediately after changing the gear position of a transmission, due to the lag in response of the air flow sensor signal and overshoot, the fuel injection amount is increased excessively. This will necessarily cause increasing of ratio of carbon monoxide (CO) or other harmful components generated in the exhaust gas. Furthermore, within a range of correction coefficients substantially close to 1 where switching between λ-control and open loop control is frequently performed, hunting is increased and driving efficiency is decreased.

SUMMARY OF THE INVENTION

With the above in mind, an object of the present invention is to provide a fuel supply system for an internal combustion engine of an automotive vehicle of a type which has a sensor for detecting an air flow rate in an intake passage, a detector for detecting an engine speed, a sensor for detecting an oxygen concentration in an exhaust gas, a detector such as a throttle valve angle sensor for detecting an acceleration or deceleration of the engine and a two-directional table of correction coefficients with the the engine speed and the air flow rate in the intake passage as parameters and in accordance with which a feedback control of a fuel injection amount is effected so as to achieve a theoretical value of air-fuel ratio by an output of the oxygen concentration sensor if the correction coefficient is within a certain predetermined range. However the feedback control is halted and the fuel injection amount is corrected based on the correction coefficient if the correction coefficient is beyond the certain predetermined range. It is also an object of the present invention to provide an improved fuel system wherein the correction of the fuel injection amount based on the correction coefficient is not effected during accelerating or decelerating times when the air flow rate in the intake passage to be detected by the air flow rate sensor abruptly varies even if the correction coefficient is beyond the certain range.

Another object of the present invention is to provide a fuel supply system for an internal combustion engine of the above-mentioned type which is improved in such a way as to provide a hysteresis for the λ-control of the fuel injection amount and the correction of the fuel injection rate based on the correction coefficient, thereby preventing the occurrence of hunting as well as the frequent variance of the air-fuel mixture concentration and achieving a stable control and maintaining a good driving condition.

The other objects and advantages of the invention will be understood in connection with the hereafter description of the preferred embodiments of the invention.

BRIEF DESCRIPTION OF THE DRAWINGS

The present invention will be illustrated more fully by way of examples with reference to the accompanying drawings, in which.

DETAILED DESCRIPTION OF THE PRESENT INVENTION

One of typical construction of the fuel supply system of the above-mentioned type will be illustrated with reference to FIG. 1 and FIG. 2.

Figure 1:
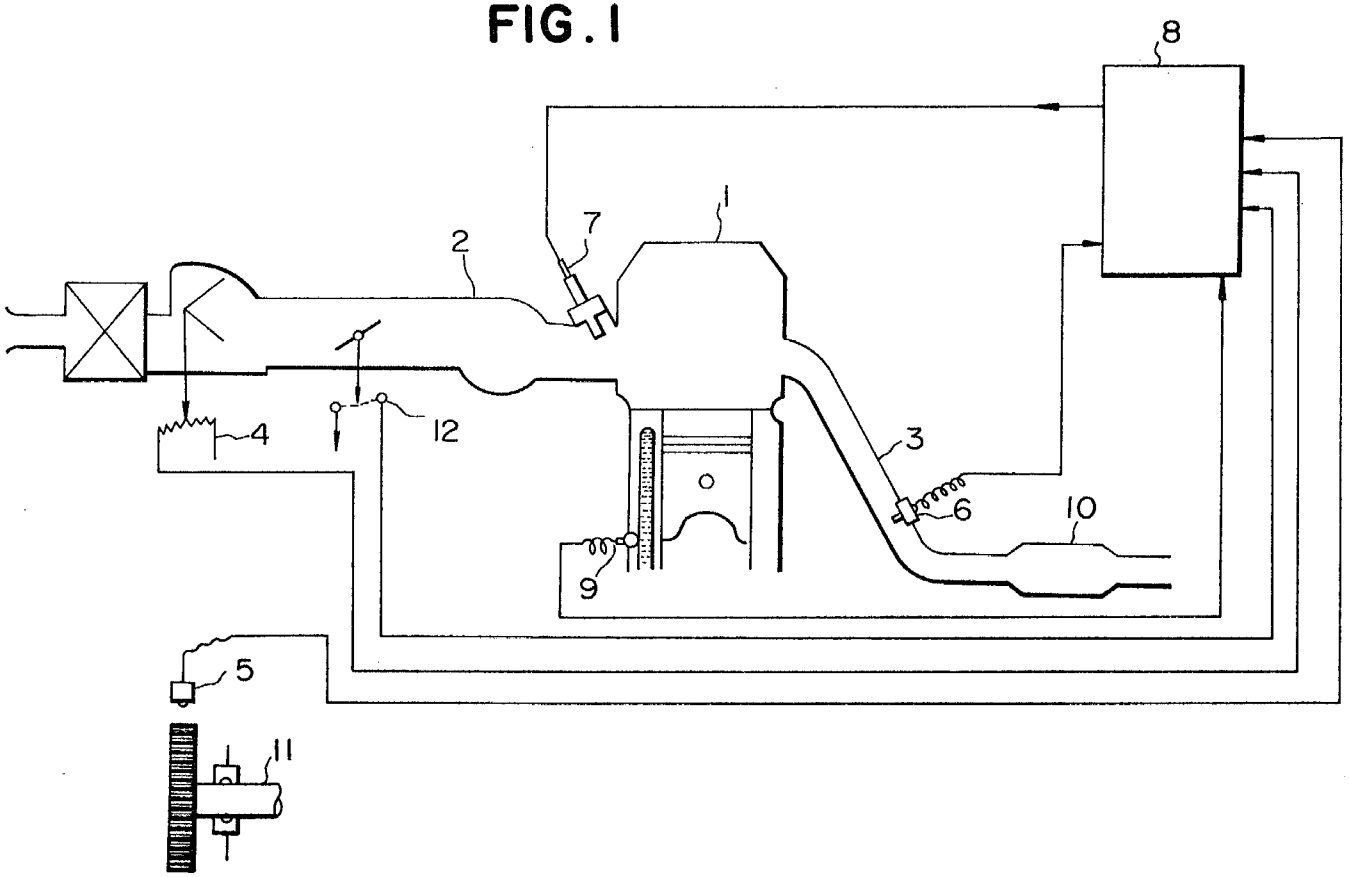
FIG. 1 is a diagrammatical view of a fuel supply system for an internal combustion engine of an automotive vehicle.

In FIG. 1, there is shown a general construction of an internal combustion engine having an electronic controlled fuel supply system. Reference numerals 2 and 3 denote an intake passage and an exhaust passage, respectively, connected to a combustion chamber 1. A fuel injector 7 with a fuel injection valve is provided in an intake manifold 2 of the intake passage 2. The fuel injector 7 is also provided with an actuator means for opening and closing the fuel injection valve. The actuator means is operated electrically in response to a control signal indicating a pulse duty corresponding to which the ratio of the energized period and de-energized period of the actuator is determined. Fuel is injected from the fuel injector 7 and is mixed with air flowing through the intake passage 2 to form an air-fuel mixture, which is charged into the combustion chamber 1 and ignited. The exhaust gas from the combustion chamber 1 flows through the exhaust passage 3, and the incompletely burned carbon monoxide hydrocarbons in the exhaust gas are oxidized through an exhaust gas purifier 10 with a catalyst. At the same time, the nitrogen oxides are reduced by the catalyst in the purifier 10, thereby purifying the exhaust gas.

The flow rate of the air flowing through the air intake passage 2 is detected by an air flow meter 4. A throttle valve angle sensor 12 is mechanically connected to a throttle valve provided in the intake passage 2 so that it may detect opening and closing of the latter. The throttle valve angle sensor 12 turns on in response to closing of the throttle valve and thereby indicates the vehicle being decelerated. An engine coolant temperature sensor 9 for measuring temperature of a coolant such as cooling water is inserted into a coolant chamber in the engine cylinder block and exposed to the coolant. The oxygen concentration of the exhaust gas flowing through the exhaust passage 3 is measured by means of an exhaust gas sensor 6 such as oxygen sensor which is provided in the exhaust pipe 3. A crank angle sensor 5 determines revolution speed of the crank shaft 11 based on crank angle signal and crank standered angle signal so that it measures engine speed. Reference numeral 8 denotes a micro processor which includes a CPU (central processing unit), an ROM (read-only memory), an input-output interface circuit and so on.

The signals representing the air flow rate, the engine speed, the exhaust gas oxygen concentration, the engine coolant temperature and the thottle valve position are inputted to the a micro processor 8, which then calculates and determines the required fuel injection amount and electrically drives the actuator means of the injector 7 to inject fuel into combustion chamber 1.

Figure 2:
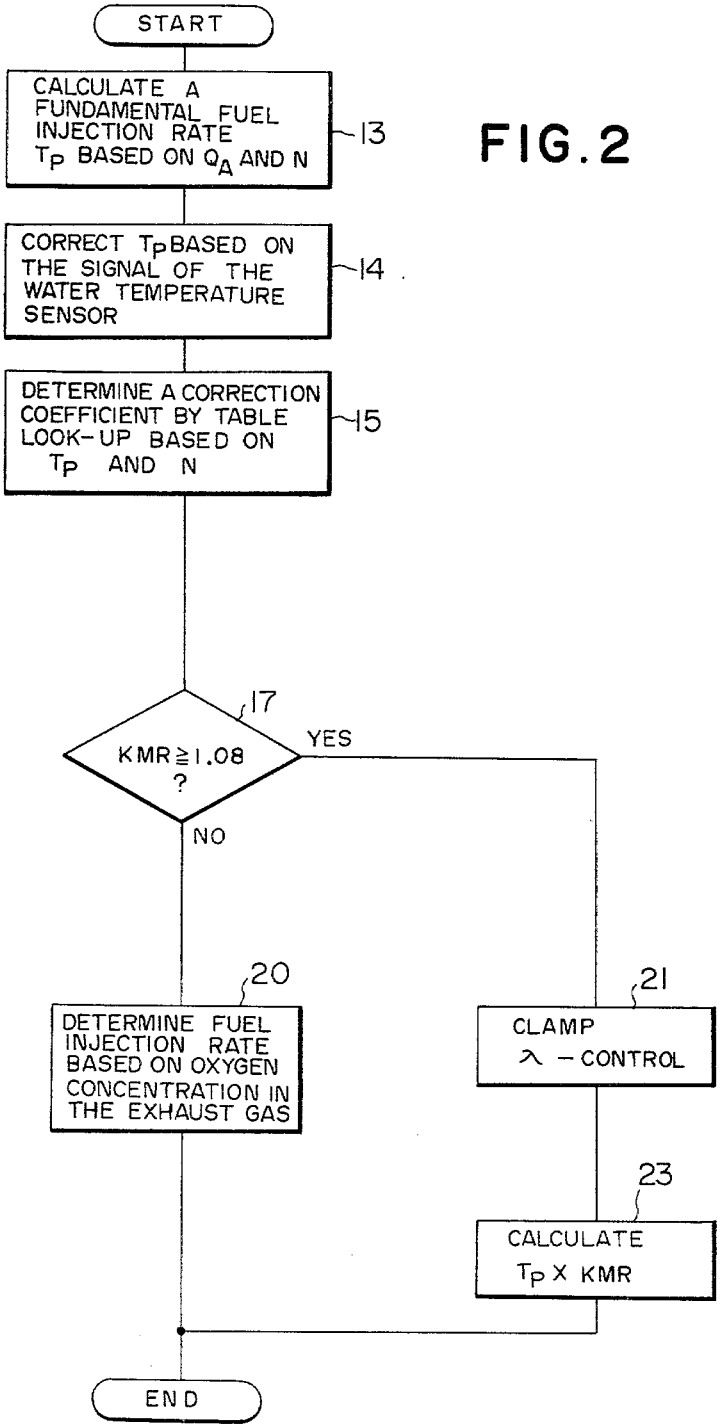
FIG. 2 is a flowchart of a fuel supply control system of FIG. 1 for calculating and determining the fuel requirement.

FIG. 2 is a flowchart showing a process for calculating and determinating the fuel requirement.

Initially, a fundamental or basic fuel injection amount $T_p$ is calculated from an input $Q_A$ indicative of the air flow rate fed from the air flow rate sensor 4 and an input N indicative of the engine speed fed from the crank angle sensor 5 (Ref. block 13). This fundamental rate $T_p$ for fuel injection amount is expressed by the following formula.

$$T_p = K \cdot Q_A / N \text{ (K: constant)}$$

That is, the fundamental fuel injection amount $T_P$ is proportional to the air flow rate in the intake passage 2 and inversely proportional to the engine speed N.

Next, the basic fuel injection amount correction factor is corrected corresponding to the input indicative of the coolant temperature fed from the engine coolant water temperature sensor 9 (Ref. block 14).

Thereafter, a correction coefficient KMR is read out and/or interpolated (Ref. block 15) from a coefficient table previously stored in the ROM in the micro processor 8 based on the calculated fuel injection amount $T_p$, corrected based on the coolant temperature and the instantaneous engine speed N.

In the block 17, the correction coefficient KMR, obtained in the block 15 and a given valve, for example, 1.08 are compared with each other. If the correction coefficient KMR is less than 1.08, λ-control based on the signal from the oxygen concentration sensor 6 is carried out (Ref. block 20). If the coefficient KMR is equal to or greater than 1.08, λ-control is clamped (Ref. block 21) and the fuel injection amount calculated using the correction coefficient KMR.

Figures 3, 4:
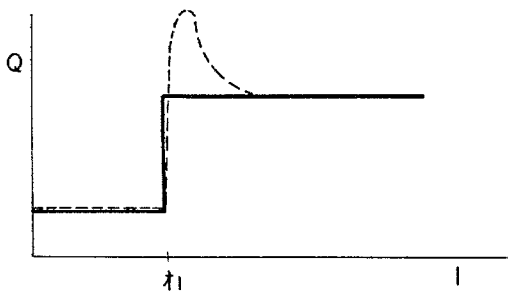
FIG. 3 is a table of correction coefficients.
FIG. 4 is a time/air flow rate graph comparing the air flow rate in the intake passage with the rate of air of actually introduced into the combustion chamber upon acceleration.

FIG. 4 shows the manner that the air flow rate Q in the intake passage varies in time (t) when the throttle valve angle is varied to increase air flow rate therethrough at time ($t_1$) to accelerate the engine. The solid line indicates the air flow rate actually introduced into the combustion chamber 1 while the dotted line indicates the output of the air flow sensor 4 for detecting the air flow rate in the intake passage 2. As shown in FIG. 4, the intake passage flow rate initially lags the air flow meter signal when the throttle valve is initially opened, but almost as instantly recovers and temporarily surpasses the combustion chamber flow rate. Deceleration also results in similar flow rate lag and recovery characteristics. As a result, the intake passage air flow rate and the correction coefficient calculations are erroneous.

Furthermore, in a driving condition in which the correction coefficient varies in a range between the λ-control correction method and the correction coefficient method, hunting is increased and driving efficiency is decreased.

Figure 5:
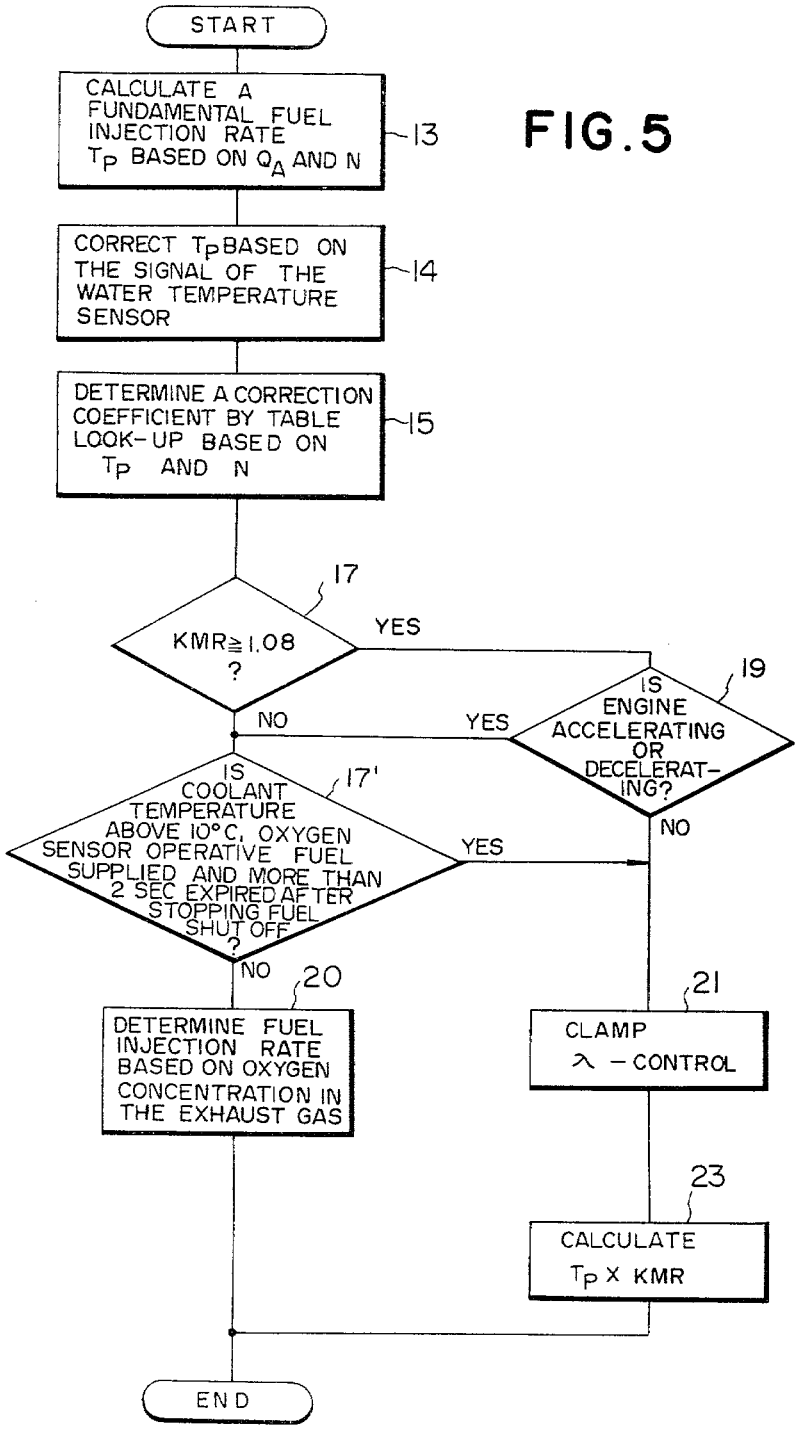
FIG. 5 is a flowchart of one of modification of the fuel supply system of FIG. 1 for determining fuel injection rate.

The present invention will now be described in terms of a preferred embodiment, and with reference to the flowchart which is shown in FIG. 5.

The flowchart of the operation of the device of the present invention includes a block 19 to decide whether the engine is being accelerated or decelerated, for example, whether the instantaneous time is within two seconds after the transmission gear change operation.

The correction coefficient KMR read out from the ROM based on the engine speed determined by the crank angle sensor 5 and air flow rate determined by the air flow meter 4, in block 15. The determined correction coefficient is compared with a given value, for example, 1.08, in block 17. When the correction coefficient is less than 1.08, if the engine condition is adapted to carry out λ-control is checked in block 17'. In the block 17', the coolant temperature, the exhaust gas sensor condition and fuel supply condition is checked. If the coolant temperature is less than a given temperature, e.g. 10° C., the exhaust gas sensor is in an inoperative condition or fuel supply system is fuel shut off condition, λ-control is clamped in block 21. Otherwise, the correction of the fuel injection amount by the λ-control is carried out based on the oxygen concentration in the exhaust gas determined by the exhaust gas sensor in the block 20. On the other hand, when the correction coefficient KMR is equal to or greater than 1.08, a decision is made as to whether the time is within two seconds after the gear change operation in block 19 prior to clamping the λ-control of the fuel injection amount in block 21 and correcting the fuel injection amount based on the correction coefficient KMR in the block 23. If the instantaneous time is not within two seconds after the gear change operation, the λ-control of the fuel injection amount is also clamped in block 21 and then the fuel injection amount is corrected in the block 23 based on the correction coefficient KMR. However, as the result of the above-mentioned decision in the block 19, if the instantaneous time is within two seconds after the gear change operation, the fuel injection amount is corrected by the λ-control in the block 20 without regard to the correction coefficient. In this case, whether the time is within two seconds after the gear change operation is decided from the switching off or on operation of the throttle valve angle sensor 12 and a timer incorporated with the throttle valve angle sensor 12.

By effecting only the λ-control of the fuel injection rate in the accelerating or decelerating driving condition in which the air flow rate in the intake passage 2 to be detected by the sensor 4 abruptly varies as explained before with reference to FIG. 4, it is possible to avoid the unfavorable influence due to the response delay and overcompensation of the output of the sensor 4 for detecting the air flow rate in the intake passage 2 at the time when the engine is accelerated or decelerated.

As mentioned above, the fuel injection amount is corrected by the λ-control if the correction coefficient KMR is less than 1.08 or if the instantaneous time is within two seconds after the gear change operation even if the correction coefficient KMR is equal to or greater than 1.08.

In accordance with the flowchart in FIG. 5, it is possible to avoid any unfavorable influence due to the response delay and overcompensation of the air flow rate sensor 4 output when the engine is being accelerated or decelerated. However, the control method of the fuel injection rate is frequently changed between the λ-control and the correction based on the correction coefficient KMR in a driving condition in which the correction coefficient KMR frequently varies in a boundary range between the limit for correction by λ-control and the limit for correction based on the correction coefficient KMR. If the control method of the fuel injection amount frequently varies across such range, engine hunting occurs and the driving condition worsens.

Figure 6:
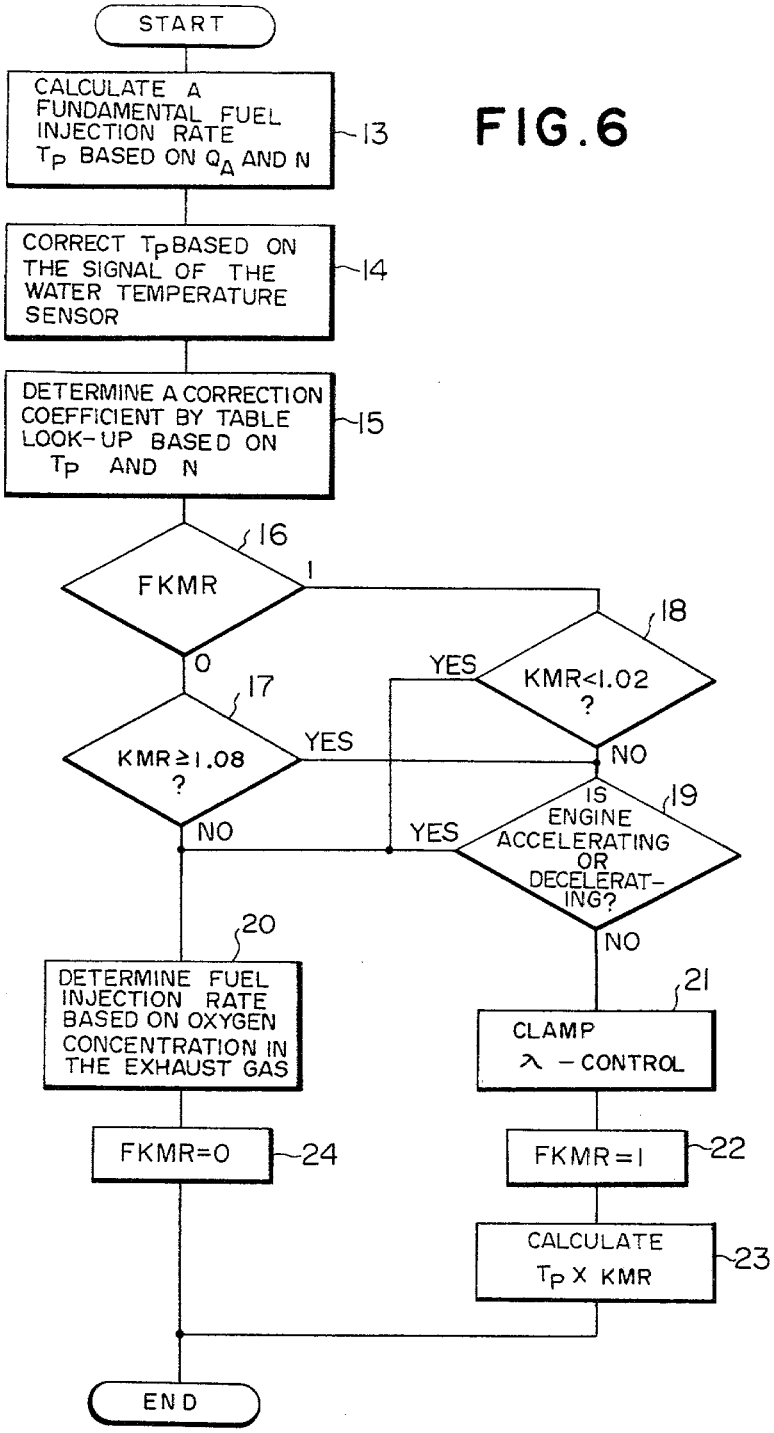
FIG. 6 is a flowchart of a second modification of the fuel supply system of FIG. 1 for determining fuel injection rate.
Figure 7:
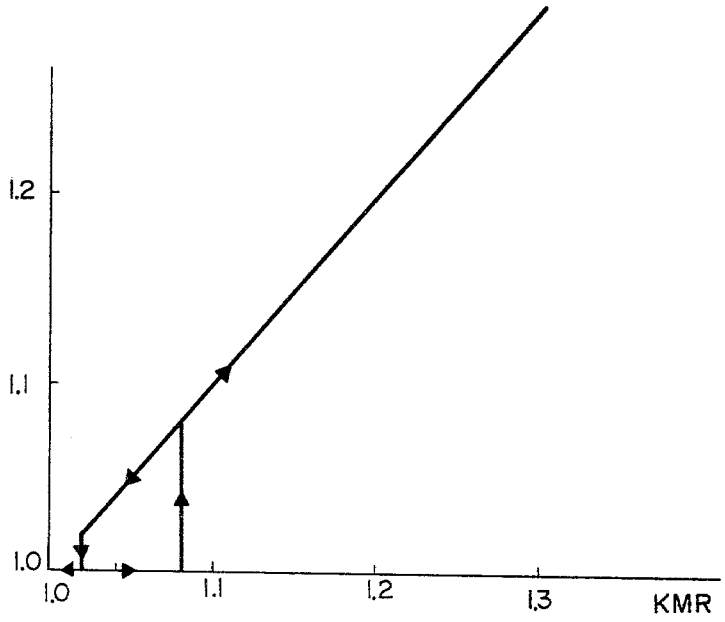
FIG. 7 is a graph of the hysteresis effect of the second modification of the system of the present invention.

FIG. 6 is a flowchart of another modification which provides a hysteresis for the λ-control and open loop control in which the fuel injection amount is corrected based on the correction coefficient KMR, thereby avoiding the frequent alternation between the λ-control correction and the open loop control. A hysteresis loop as shown in FIG. 7 of which the abscissa indicates the correction coefficient KMR and the ordinate indicates the actual correction coefficient may be provided for operation in accordance with the device of the flowchart of FIG. 6.

In the flowchart of FIG. 6, there is provided a block 16 in which a flag FKMR indicative of clamping the λ-control is checked. The flag FKMR is set in a block 22 for setting a digital value "1" in the flag FKMR and reset in a block 24 for setting the flag FKMR as "0", so that eigher digital value "1" or "0" may be chosen. There is also provided a block 18 for comparing the correction coefficient KMR with a second given value, for example, 1.02 which is different from and less than the first given value 1.08 which is employed in the block 17.

If the correction coefficient KMR becomes greater than 1.08 during the λ-control correction of the fuel injection amount, the λ-control is clamped (Ref. block 21) and open loop control for determining fuel injection amount by calculation of the basic fuel injection amount and correction coefficient KMR (Ref. block 23). If the correction coefficient KMR becomes less than 1.02 during the open loop control, control operation is switched from the open loop control to λ-control so that the fuel injection rate is determined corresponding to the oxygen concentration to control the air/fuel ratio of the air-fuel mixture to approach to the required ratio (Ref. block 20).

The flag FKMR in the block 16 is initially set to "0" and the correction coefficient KMR is compared with 1.08 in block 17. If the correction coefficient KMR is less than 1.08, the λ-control is carried out for correcting the fuel injection amount based on oxygen concentration in the exhaust gas (block 20) and the FKMR for block 16 is set at "0". However, if the correction coefficient KMR is equal to or greater than 1.08 and if the engine is not accelerating or decelerating condition, the λ-control is clamped (Ref. block 21). The flag FKMR is set at "1" (Ref. block 22). Thereafter, fuel injection amount is corrected based on the correction coefficient KMR (Ref. block 23). Since the flag FKMR is set at "1", the correction coefficient KMR is compared with 1.02 (Ref. block 18). If the correction coefficient KMR is less than 1.02, the λ-control is carried out (Ref. block 20) and the flag FKMR is set at "0" (Ref. block 24). Thereafter, the λ-control is carried out. At this time, the open loop control (Ref. block 23) is not carried out unless the correction coefficient KMR becomes equal to or greater than 1.08.

In such a way, it becomes posible to provide a hysteresis for the λ-control correction and the correction based on the correction coefficient KMR, thereby effectively preventing the occurrence of engine hunting.

Figure 8:
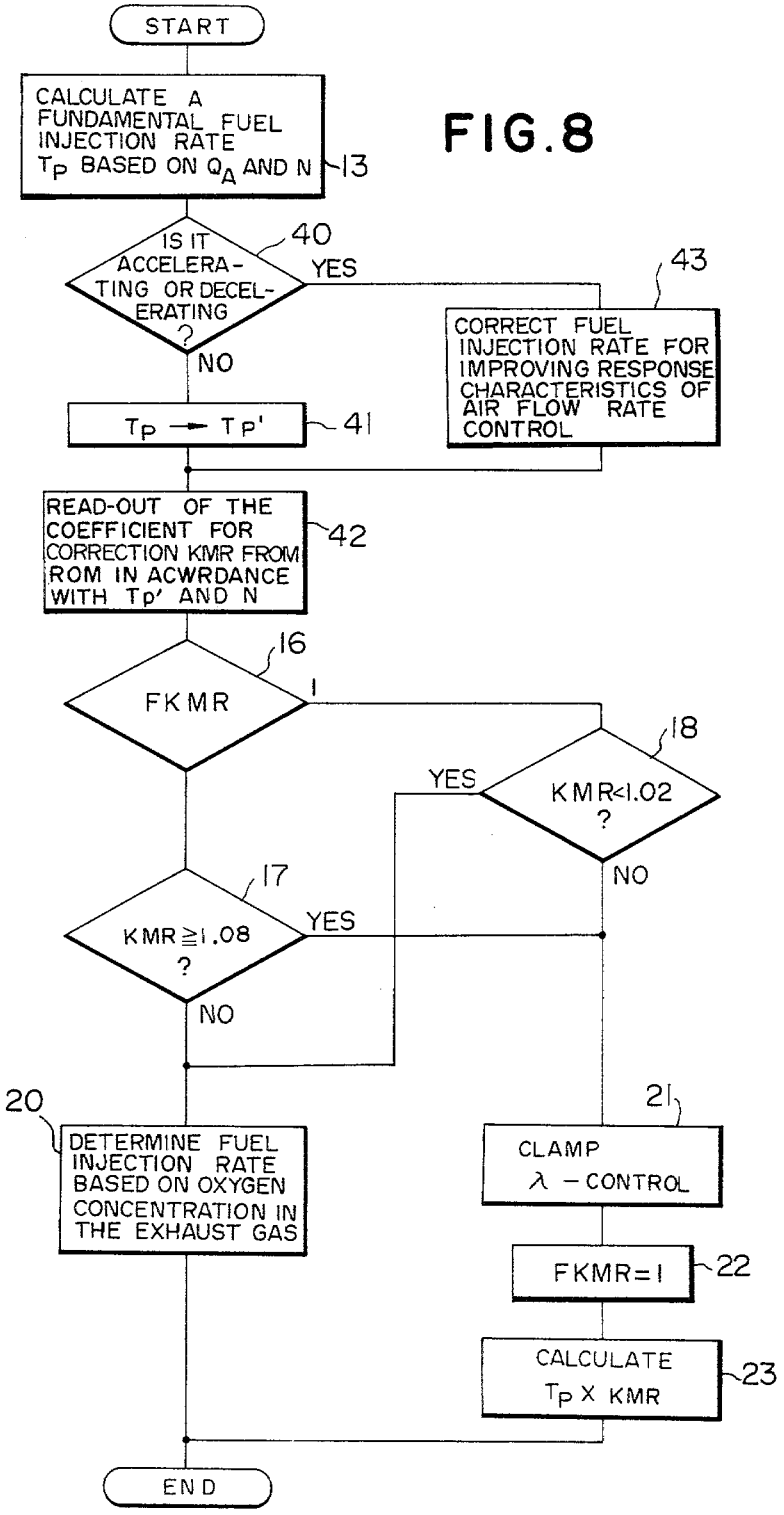
FIG. 8 is a graph of a third modification of the fuel supply system of the present invention.

FIG. 8 is a flowchart of another embodiment of the present invention. In this embodiment, the fundamental fuel injection amounttity $T_P$ is calculated based on the input $O_A$ from the sensor 4 indicating the air flow rate in the intake passage 2 and the input N from the crank angle sensor 5 indicating the engine speed (Ref. block 13). Then, a decision is made as to whether the engine is being accelerated or decelerated (Ref. block 40). If the engine is neither accelerating nor decelerating, the fundamental fuel injection amount $T_P$ obtained in block 13 is deemed as a modified fuel injection amount $T_P'$ in block 41, and a correction coefficient KMR is read out from the ROM in the micro processor 8 based on the input $Q_A$ from the air flow rate sensor 4 in the intake passage 2 and the modified fuel injection rate $T_P'$ (Ref. block 42). On the other hand, if a decision is made that the engine is being accelerated or decelerated (Ref. block 40), the fundamental fuel injection rate $T_P$ obtained in the block 13 is modified resulting in $T_P'$ (Ref. block 43) to compensate for the response delay and overcompensation of the air flow rate sensor 4 output. Then, the correction coefficient KMR is read out (Ref. block 42) from the ROM in the micro processor 8 based on the input N of the crank angle sensor 5 indicating the engine speed and the modified fuel injection rate $T_P'$ thus obtained. The process which follows hereafter in the flowchart of FIG. 8 is substantially the same as that in the flowchart of FIG. 6 and the explanation therefor will not be repeated.

Figure 9:
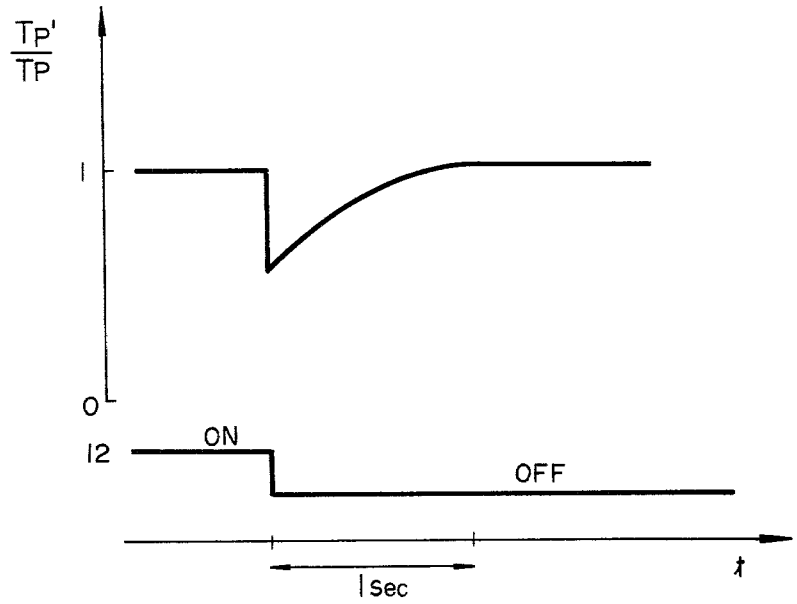
FIG. 9 is a graph of the correction of the fundamental fuel injection amount ($T_p$) during acceleration.
Figure 10:
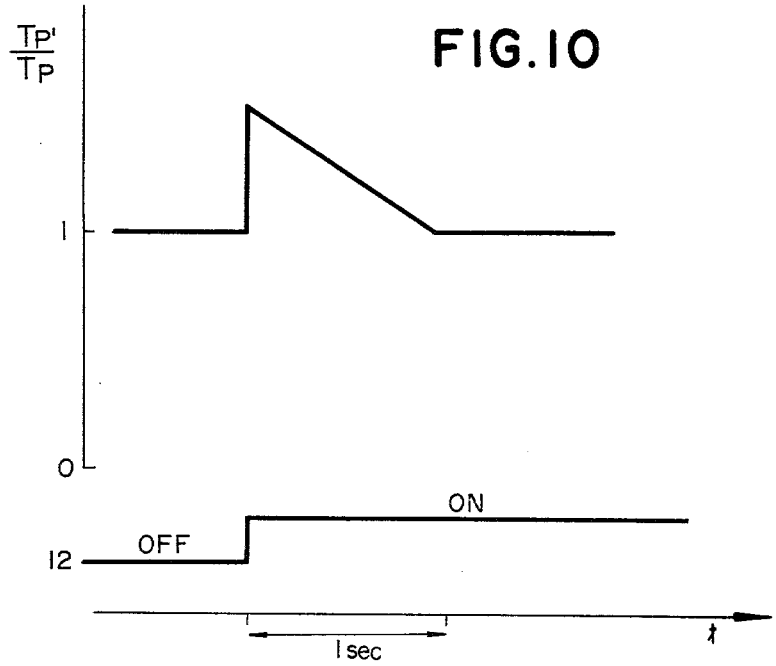
FIG. 10 is a graph of the correction of the fundamental fuel injection amount ($T_p$) during deceleration.

FIGS. 9 and 10 show the ways of decision of the acceleration and deceleration and the modified values $T_P'$ of the fuel injection quantity as explained above. The acceleration or deceleration of the engine is determined from the switching on or off of the throttle valve angle sensor 12. The decision of acceleration is given if the throttle valve angle sensor 2 is switched off as shown in FIG. 9, whereupon the fundamental fuel injection amount $T_P$ obtained in block 13 is modified into the modified fuel injection rate $T_P'$ for approximately one second in such a way that $T_P/T_P'$ may become less than 1. On the other hand, FIG. 10 shows the case of deceleration of the engine wherein the judgement of deceleration of the engine is given if the throttle valve switch 12 is switched on, whereupon the fundamental fuel injection quantity $T_P$ obtained in block 13 is modified into the modified fuel injection quantity $T_P'$ for approximately one second in such a way that $T_P/T_P'$ may become greater than 1.

Thus, any unfavorable influence due to the response delay and overcompensation of the output of the air flow rate sensor 4 in the intake passage 2 in the accelerating or decelerating driving condition of the engine may effectively be avoided by obtaining and employing the modified fuel injection amounttity value $T_P'$ in the procedure outlined in the flowchart of FIG. 8.

As will be clear from the foregoing description, the fuel supply system for an internal combustion engine of an automotive vehicle of the type described herein is improved in accordance with the present invention in such a way that the correction of the fuel injection amount based on the correction coefficient KMR is not effected during accelerating or decelerating when the air flow rate in the intake passage 2 abruptly varies even if the correction coefficient KMR is beyond the certain range. Accordingly, it is possible to avoid any unfavorable influence due to the response delay and overcompensation of the output of the sensor 4 when the engine is being accelerated or decelerated.

Further, the fuel supply system for an internal combustion engine of an automobile of the above-mentioned type is improved in accordance with the present invention in a manner to provide a hysteresis as shown in FIG. 7 for the fuel feed quantity correction by λ-control or the open loop control. Accordingly, it is possible to effectively prevent hunting and frequent variance of the air/fuel ratio of air-fuel mixture concentration, thereby achieving a stable control and maintain a good driving condition.

The present invention has been described in terms of preferred embodiments and with reference to the accompanying drawings. This, however, is not to be taken in any way as limitative of the present invention as set forth in the appended Claims. Many minor modifications to the preferred embodiments will be clear to those skilled in the art, but are intended to remain within the scope of the present invention.

What is claimed is:

1. A fuel supply control system for an internal combustion engine having open loop and λ-control modes of operation comprising:

first sensor means for determining the air flow rate flowing through an air intake passage of said engine and generating a first sensor signal indicative of the determined air flow rate;

second sensor means for determining engine speed and generating a second sensor signal corresponding to the determined engine speed;

third sensor means for determining oxygen concentration in an exhaust gas of the engine and generating a third sensor signal corresponding to the determined oxygen concentration for use in said λ-control mode of operation;

fourth means for determining a basic fuel injection amount based on values of said first and second sensor signals;

fifth means for determining a correction coefficient based on said first and second sensor signal values for correcting said basic fuel injection amount; and sixth means for discriminating whether said correction coefficient exceeds a first given value, said sixth means responsive to said fifth means for clamping λ-control when said correction coefficient exceeds said first given value and subsequently carrying out open loop control.

2. A control system as set forth in claim 1, wherein said sixth means is operative for discriminating whether said correction coefficient exceeds said first value or is lower than a second value, said second value being lower than said first value, said sixth means responsive to said fifth means for clamping λ-control when said correction coefficient exceeds said first given value and carrying out open loop control, and said sixth means acting in response to said fifth means for switching the mode of operation from open loop to λ-control when said correction coefficient is lower than said second given value.

3. A control system as set forth in claim 1, wherein said sixth means clamps switching of control operation from λ-control to open loop control in response to changing gear position of the transmission.

4. A control system as set forth in claim 2, wherein said first given value is 1.08 and said second given value is 1.02.

5. A control system as set forth in claim 1, wherein said first given value is 1.08.

6. A control system as set forth in claim 1, wherein said sixth means is operative to clamp λ-control only when said correction coefficient exceeds said first given value and said first sensor signal indicates that the air flow rate does not correspond to engine acceleration or deceleration.

7. A method for controlling the air/fuel ratio in an internal combustion engine under both open loop control and λ-control modes of operation, said method comprising the steps of:

determining the air flow rate flowing through an air intake passage and generating a first signal indicating said determined air flow rate;

determining the engine speed and generating a second signal indicating said determined engine speed;

determining oxygen concentration in the exhaust gas of said engine and generating a third signal indicative of the oxygen concentration of the exhaust gas;

determining a basic fuel injection amount based on said first and second signals respectively indicating determined air flow rate and engine speed;

determining an engine temperature and generating a fourth signal corresponding thereto;

correcting said determined fuel injection amount based on said fourth signal;

determining a correction coefficient based on said temperature corrected fuel injection amount and the second signal;

comparing said correction coefficient with a first and a second given value to discriminate whether λ-control or open loop control is to be carried out said first value being higher than said second value;

clamping said λ-control when the correction coefficient exceeds said first given value and producing open loop control by modifying said temperature corrected fuel injection amount based on said correction coefficient; and clamping open loop control when the correction coefficient is less than said second given value, and producing λ-control by sensing said third signal and controlling the air/fuel ratio at a stoichiometric value.

8. A method as set forth in claim 7, further including the steps of setting a flag indicative of a λ-control clamping condition and checking said flag.

9. A method as set forth in claim 8, wherein said steps for setting and checking said flag are performed prior to the step of clamping λ-control.

10. A method as set forth in claim 8 or 9, wherein said correction coefficient is compared with said second given value when said set flag is detected.

11. A method as set forth in claim 7, 8 or 9, wherein said step for clamping λ-control is not effected unless a given period time from opening or closing of the throttle valve detected by a throttle valve angle sensor has expired.

12. A method as set forth in claim 11, wherein when an abrupt variation of the air flow rate is detected, said basic fuel injection amount is corrected on the basis of said first signal varied responsive to said throttle valve angle sensor.

13. A method as recited in claim 7, wherein the step of clamping open loop control is operative only when said engine is not accelerating or decelerating.

14. A method as recited in claim 7, which further comprises the steps of setting a flag indicative of clamping of λ-control when the correction coefficient exceeds said first given value and thus control operation is switched from λ-control to open loop control, and checking said flag prior to the step of comparing the correction coefficient with said first and second given values.

15. A fuel supply control system for an internal combustion engine comprising:

first sensor means for detecting an air flow rate flowing through an air intake passage and producing a first sensor signal having a value proportional to the detected air flow rate;

second sensor means for detecting engine speed and producing a second sensor signal having a value proportional to the detected engine speed;

third sensor for detecting oxygen concentration in an exhaust gas and producing a third signal having a value proportional to the detected oxygen concentration;

fourth sensor means for detecting engine temperature and producing a fourth sensor signal having a value proportional to the detected engine temperature;

fifth means for determining a basic fuel injection amount based on said first and second sensor signal values and correcting the basic fuel injection value based on the fourth sensor signal value;

sixth means for determining a correction coefficient for further correcting the fuel injection amount, said correction coefficient determined by said sixth means based on said temperature corrected basic fuel injection amount and said second sensor signal value;

seventh means for effecting λ-control based on said third sensor signal value;

eighth means for effecting open loop control, said eighth means calculating a final fuel injection value by correcting the fuel injection amount determined by said fifth means by the correction coefficient determined by said sixth means; and ninth means for selectively operating said seventh and eighth means, said ninth means comparing said correction coefficient with first and second reference values respectively defining first and second threshold values, said ninth means clamping operation of said seventh means, when the correction coefficient exceeds said first reference value to switch from λ-control to open loop control and clamping operation of said eighth means when the correction coefficient is lower than said loop control to switch control mode from open loop control to -control.

16. A system as set forth in claim 15, wherein said ninth means includes a flag setting means resonsive to clamping λ-control and means for checking said flag, said ninth means comparing said correction coefficient with said first reference value when said flag is not set and with said second reference value when flag is set.

17. A system as set forth in claim 15, wherein said first reference value is greater than the second reference value.

18. A system as set forth in claim 17, wherein said correction coefficient is read out from a prestored data table with respect to the temperature corrected basic fuel injection amount and engine speed.

* * * * *